United States Patent [19]

Wenstadt et al.

[11] Patent Number: 4,622,938

[45] Date of Patent: Nov. 18, 1986

[54] TIMING AND THROTTLE LINKAGE

[75] Inventors: Thomas D. Wenstadt, Winthrop Harbor, Ill.; Marcus W. Hagen, Racine, Wis.

[73] Assignee: Outboard Marine Corporation, Waukegan, Ill.

[21] Appl. No.: 702,423

[22] Filed: Feb. 14, 1985 (Under 37 CFR 1.47)

Related U.S. Application Data

[63] Continuation of Ser. No. 541,466, Oct. 13, 1983, abandoned.

[51] Int. Cl.[4] ..... F02D 37/00; F02D 9/00; F02P 5/04

[52] U.S. Cl. ..... 123/413; 123/342

[58] Field of Search ..... 123/413, 342, 369, 370, 123/371, 376

[56] References Cited

U.S. PATENT DOCUMENTS

| | | | |
|---|---|---|---|
| 1,611,054 | 12/1926 | Mayoral | 123/413 |
| 2,635,595 | 4/1953 | Raleigh | 123/413 |
| 2,906,251 | 9/1959 | Soder, Jr. | 123/413 |
| 2,988,074 | 6/1961 | Lobdell et al. | 123/413 |
| 3,195,529 | 7/1965 | Walker | 123/413 |
| 3,721,223 | 3/1973 | Randau et al. | 123/413 |
| 3,769,949 | 11/1973 | Elingsen | 123/413 |
| 3,807,372 | 4/1974 | Garcea | 123/413 |

FOREIGN PATENT DOCUMENTS

| | | | |
|---|---|---|---|
| 497290 | 12/1938 | United Kingdom | 123/413 |
| 975079 | 11/1964 | United Kingdom | 123/413 |

*Primary Examiner*—Raymond A. Nelli

*Attorney, Agent, or Firm*—Michael, Best & Friedrich

[57] ABSTRACT

A throttle and timing control for a spark ignition internal combustion engine having a fuel/air mixing device and a spark timing device. A first lever is mounted on a pivot on the engine and includes a shaped cam slot a portion of which has a substantially uniform radius about said pivot and a portion of which has specifically non-constant radii about said pivot. A manual control is connected to the lever to actuate the lever about the pivot. A second pivot on the engine has an axis perpendicular to the axis of the first pivot and journals a second lever which controls the timing of the spark ignition. A spherical cam follower on the second lever engages and rolls in the cam slot so as to follow motion of the cam slot while turning the plane of movement 90°. A third pivot on the engine is spaced from the other pivots and journals a lever operably connected to the fuel/air metering device. A link interconnects the first and third lever.

6 Claims, 3 Drawing Figures

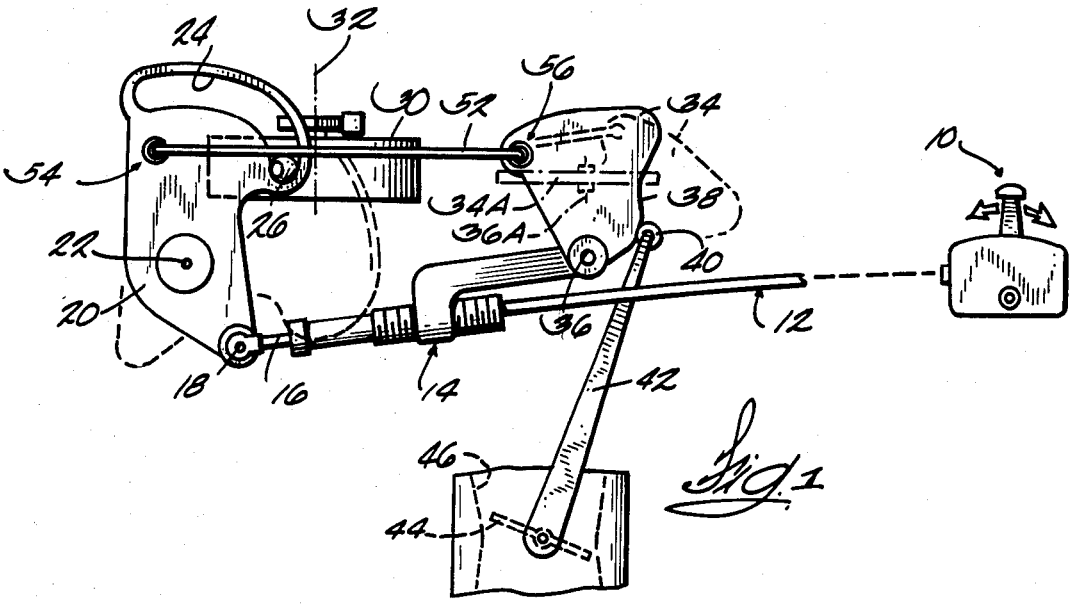
Fig. 1
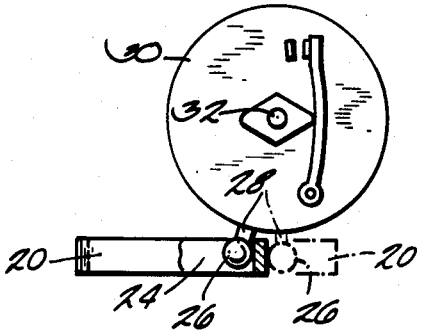
Fig. 2
Fig. 3
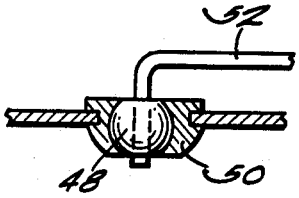

TIMING AND THROTTLE LINKAGE

FIELD OF THE INVENTION

This invention relates to throttle and timing linkages for internal combustion engines. This application is a continuation of Ser. No. 541,466, filed 10/13/83, now abandoned.

BACKGROUND OF THE INVENTION

While the present invention has application to internal combustion engines used for various purposes, the following description will relate the engine primarily to an outboard motor. In conjunction with an outboard motor, the throttle push-pull cable actuates not only the butterfly valve in the carburetor(s) but is also used to adjust the timing of the spark ignition system. Since the timing is not advanced uniformly over the throttle range of the engine, but in fact is held constant over a large part of the range, the motion imparted to the timing device is presently derived from a spring loaded, lost motion system of levers. The durability and ease of operation of the throttle linkage can be improved by eliminating the spring force. In order to get the desired motion, without the spring load, a cam is used. In many outboard motors the timing lever and the throttle lever are on pivot axes 90° apart. Transferring motion from a cam slot to a follower moving in a plane at 90° to the cam has not been done.

SUMMARY OF THE INVENTION

This invention provides a timing and throttle control for a spark ignition internal combustion engine having a fuel/air mixing device and a spark timing device, the control comprising, a pivot on said engine, a first lever mounted on the pivot and including a shaped cam slot a portion of which has a substantially uniform radius about said pivot and a portion of which has specifically non-constant radii about said pivot, control means connected to the lever to actuate the lever about the pivot, a second pivot on the engine not parallel to the first pivot, a second lever mounted on said second pivot and operative to control the timing of the spark ignition system, a spherical cam follower mounted on the second lever and engaged with the cam slot, a third pivot on the engine spaced from the other pivots, a third lever mounted on the third pivot, said third lever being operatively connected to the fuel/air metering device, and a link inter-connecting the first lever and the third lever.

A further feature is that the spherical cam follower rolls in said cam slot. The use of a spherical roller allows the first and second pivots to be at 90° to each other and this makes it possible to turn the plane of motion 90° without use of additional intermediate levers.

This invention is not limited to the details of construction and the arrangement of components set forth in the followng description or illustrated in the drawings. The invention is capable of other embodiments and of being practiced and carried out in various ways. Also, it is to be understood that the phraseology and terminology employed herein is for the purpose of description and should not be regarded as limiting.

BRIEF DESCRIPTION OF THE DRAWINGS

FIG. 1 is a schematic showing of a spherical roller timing and throttle control having a spherical follower actuated by cam track.

FIG. 2 is plan view of the timing control and follower shown in FIG. 1.

FIG. 3 is a detail view of the link connection to a lever plate.

DETAILED DESCRIPTION OF THE DRAWINGS

When the operator of the boat actuates the throttle control 10, the push-pull cable 12 is actuated. The cable is anchored at clamp 14 which is fixed to the engine block or other suitable place. The operating wire 16 of the push-pull cable is connected at 18 to first lever 20 pivotally mounted at 22 on the engine block. Lever 20 is somewhat like a plate and has a cam slot 24 located further from the pivot 22 than is the connection point 18 between the lever and the push-pull cable. Thus, the motion at the cam slot 24 is multiplied.

A portion of the cam slot is generated at a constant radius about the center of pivot 22 so follower 26 is retained in a fixed position when the lever moves. But when the follower is in that portion of the slot in which the radius is not uniform the follower must move. The spherical follower 26 is mounted on an arm 28 projecting from timing device 30 pivoted at 32. The follower 26 is a spherical roller. The rolling action minimizes galling and provides smooth action. Since the axes of two pivots 22 and 32 are perpendicular, the follower can accommodate motion in both planes and causes the timing device to move to advance or retard the spark timing as dictated by the shape of the cam slot 24. Device 30 is a schematic representation of a timing rotor which has a recognizeable form but which in contemporary engineering would more likely be a device for positioning a trigger coil relative to a rotating magnet to change the spark timing. The use of a spherical roller follower enables the plane of motion to be turned 90° without use of intermediate levers, etc. The device 30 can be considered a lever.

A third lever 34 pivots about pivot 36, normally in a plane parallel to the plane of lever 20. As shown in dotted lines at 34A the lever could be in another plane at 90° and pivot about pivot 36A. Lever 34 (or 34A) is provided with a shaped surface or cam 38 and roller 40 on a lever 42 follows and is actuated by the surface 38 to in turn set the butterfly valve 44 in the carburetor 46.

Each of the levers 20 and 34 is provided with a connector of the general type schematically illustrated in FIG. 3. This has a somewhat spherical plastic ball 48 retained in the associated plate by shaped bushing 50. This permits the ball to have free motion relative to the plane of the associated lever. Therefore, a stiff wire or rod-type connector link 52 can be connected at each end to a ball 48 by pressing the end of the link 52 through the central aperture of the ball. The link 52 is connected to the first lever 20 at 54 and is connected to lever 34 at 56. The link can be shaped in any desired way to adjust and transfer the motion between the levers. The advantage of this arrangement is that misalignment between the levers can be readily accommodated.

We claim:

1. A timing throttle control for a spark ignition internal combustion engine having a fuel/air mixing device and a spark timing device, said control comprising a first pivot on the engine, a first lever mounted on said pivot and including a cam slot having a first portion which has a substantially uniform radius about said pivot and a second portion which has a non-constant radii about said first pivot, control means connected to said first lever to actuate said first lever about said first pivot, a second pivot on the engine in non-parallel relation to said first pivot, a second lever mounted on said second pivot and operative to control the timing of the spark timing device, a spherical cam follower mounted on said second lever and engaged with said cam slot, a third pivot on the engine spaced from said first and second pivots, a third lever mounted on said third pivot and operatively connected to the fuel/air mixing device, and a link interconnecting said first lever and said third lever.

2. A control according to claim 1 wherein said follower is a spherical roller which rolls within said cam slot and transfers motion from said first lever to said second lever and the pivot axes of said first and second levers are in planes perpendicular to each other.

3. A control according to claim 2 wherein said cam slot in said first lever is at a different distance from said first pivot than the connection of said control means to said first lever.

4. A timing throttle control for a spark ignition internal combustion engine having a fuel/air mixing device and a spark timing device, said control comprising a first lever mounted on the engine for movement about a first axis, including a cam surface, and being adapted to be connected to a control means for actuating said first lever about said first axis, a second lever mounted on the engine for movement about a second axis in non-parallel relation to said first axis and operative to control the timing of the spark timing device, a spherical cam follower mounted on said second lever and engaged with said cam surface, a third lever mounted on said engine for movement about a third axis spaced from said first and second axes and operatively connected to the fuel/air mixing device, and a link interconnecting said first lever and said third lever.

5. A control according to claim 4 wherein said cam surface is a cam slot and wherein said cam follower is a spherical roller which rolls within said cam slot and transfers motion from said first lever to the said second lever and said first and second axes are in planes perpendicular to each other.

6. A control according to claim 4 wherein said cam slot in said first lever is at a different distance from said first axis than the connection of the control means to said first lever.

* * * * *